US007246757B2

(12) United States Patent
Juo

(10) Patent No.: US 7,246,757 B2
(45) Date of Patent: Jul. 24, 2007

(54) NOZZLE COVER OF AIR BRUSH

(75) Inventor: Chung-Tsuen Juo, Taichung (TW)

(73) Assignee: Victor Air Tools Co., Ltd., Taichung County (TW)

( * ) Notice: Subject to any disclaimer, the term of this patent is extended or adjusted under 35 U.S.C. 154(b) by 155 days.

(21) Appl. No.: 11/118,425

(22) Filed: May 2, 2005

(65) Prior Publication Data

US 2006/0255178 A1 Nov. 16, 2006

(51) Int. Cl.
*B05B 7/30* (2006.01)

(52) U.S. Cl. ..... 239/353; 239/288; 239/319; 239/346; 239/375; 239/379; 239/414; 239/600; 239/DIG. 11; 285/9.1; 403/DIG. 1

(58) Field of Classification Search ..... 239/288, 239/288.3, 288.5, 319, 345, 346, 353, 379, 239/414, 600, DIG. 11, 375, 376; 285/9.1; 403/DIG. 1

See application file for complete search history.

(56) References Cited

U.S. PATENT DOCUMENTS

| | | | | | |
|---|---|---|---|---|---|
| 2,793,057 | A * | 5/1957 | McGugin | ..... | 285/9.1 |
| 3,181,895 | A * | 5/1965 | Cator | ..... | 285/9.1 |
| 4,049,295 | A * | 9/1977 | Piers | ..... | 285/9.1 |
| 4,260,180 | A * | 4/1981 | Halushka et al. | ..... | 285/9.1 |
| 4,896,384 | A * | 1/1990 | Dijkhuizen | ..... | 239/414 |
| 5,318,328 | A * | 6/1994 | Dawson | ..... | 285/9.1 |

* cited by examiner

*Primary Examiner*—Steven J. Ganey
(74) *Attorney, Agent, or Firm*—Rosenberg, Klein & Lee

(57) ABSTRACT

An air brush includes a brush member with a head portion at an end and a nozzle on the head portion. A nozzle cover is detachably bonded to the nozzle. The nozzle cover has a first attracting portion, and the nozzle has a second attracting portion associated with the first attracting portion. The first attracting portion and the second attracting portion are attracted together by a magnetic force to bond the nozzle cover to the nozzle.

2 Claims, 6 Drawing Sheets

NOZZLE COVER OF AIR BRUSH

BACKGROUND OF THE INVENTION

1. Field of the Invention

The present invention relates generally to an air brush, and more particularly to an air brush having a nozzle cover, which is fitted to the nozzle by magnet.

2. Description of the Related Art

The air brush is used for painting on a predetermined object, such as canvas. The conventional air brush has a nozzle cover fitted to the nozzle to prevent the nozzle from damage. After painting, the nozzle has paint left thereon. After a time of use, the nozzle is contaminated by paints of various colors, so that the nozzle has to be washed frequently to prevent it from jam. The painter usually has to disassemble the nozzle to check the spray angle of paint for adjustment of paint flow. Therefore, the nozzle cover is assembled and disassembled frequently. If there is a poor design for the nozzle cover, it troubles the painter very much.

FIG. 7 and FIG. 8 show a conventional air brush including a brush member 7, a paint container 8, a gas injection member 84 and a control assembly 9. The brush member 7 has a chamber 71 therein and defines a head portion 82 and a rear portion 83 at opposite ends thereof. A nozzle 721 having an opening 722 is provided at the head portion 72 of the brush member 7. A nozzle cover 723 is screwed onto the nozzle 721. The paint container 8 has a cup 81 to receive paint therein. The cup 81 has an opening 82 at a top thereof and a bore 83 at a bottom thereof. The bore 83 communicates the cup 81 with the chamber 71 in the brush member 7. The gas injection member 84 is connected to the brush member 8 to issue high pressure gas to the nozzle 722, which has a valve 91 to open or close the gas injection member 84. The control assembly 9 is received in the brush member 7 to control the paint flow.

To wash the nozzle 721, the nozzle cover 723 has to be loosed and taken out. After wash, the nozzle cover 723 has to be screwed onto the nozzle 721. The nozzle cover 723 has to be screwed for loosing and tightening by fingers. It is an inconvenient operation. Because the nozzle cover 723 is tiny, user is easy to lose the nozzle cover 723 in wash process. The user has to pay a lot attention to the nozzle cover 723 in the wash process.

In the operation of adjustment of paint flow, it has to disassemble the nozzle cover 723. It raises the risk to lose the nozzle cover 723.

In conclusion, the nozzle cover 723 has to be disassembled and assembled frequently. The convention of assembling and disassembling the nozzle cover 723 is screwing that is an inconvenient way. If one screws the nozzle cover 723 too tight, it will be hard to loose. The main drawback is that it has very high risk to lose the nozzle cover 723.

SUMMARY OF THE INVENTION

The primary objective of the present invention is to provide a paint brush, which the nozzle cover is attracted on the nozzle by magnetic force to prevent it from losing.

According to the objective of the present invention, an air brush comprises a brush member having a head portion, on which a nozzle is provided, and an air channel communicated with the nozzle. A paint container is provided on the brush member, which has a cup with an opening at a top and a bore at a bottom communicated with the brush member. A gas injection member is connected to the brush member and communicated with the air channel to issue a high pressure gas to the nozzle. A valve assembly is received in the gas injection member to control a paint flow in the nozzle. The nozzle cover has a first attracting portion, and the nozzle has a second attracting portion associated with the first attracting portion. A magnetic force is provided between the first attracting portion and the second attracting portion to attract the first attracting portion and the second attracting portion together.

DETAILED DESCRIPTION OF THE INVENTION

Figure 1:
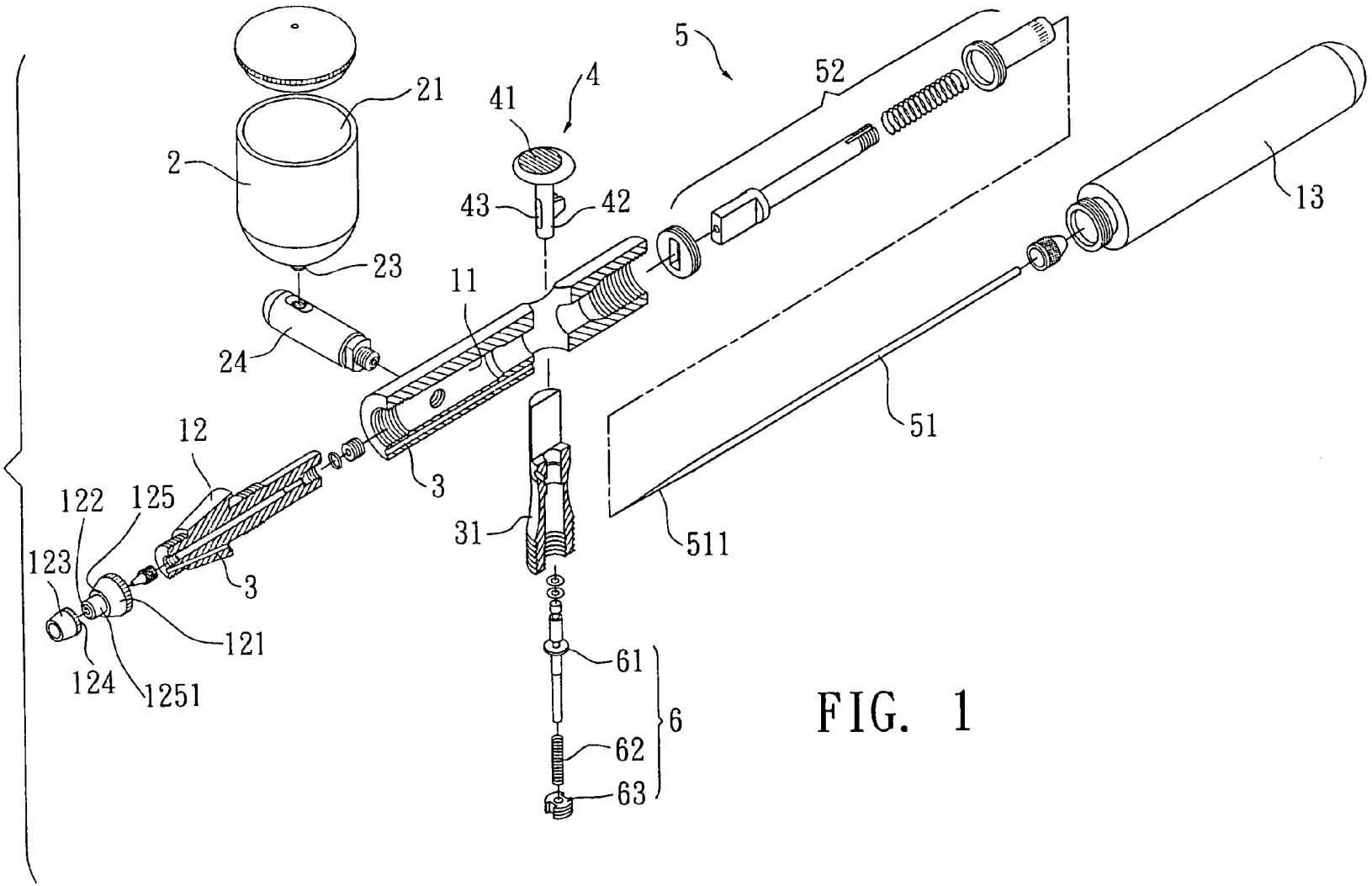
FIG. 1 is an exploded view of a first preferred embodiment of the present invention.
Figure 2:
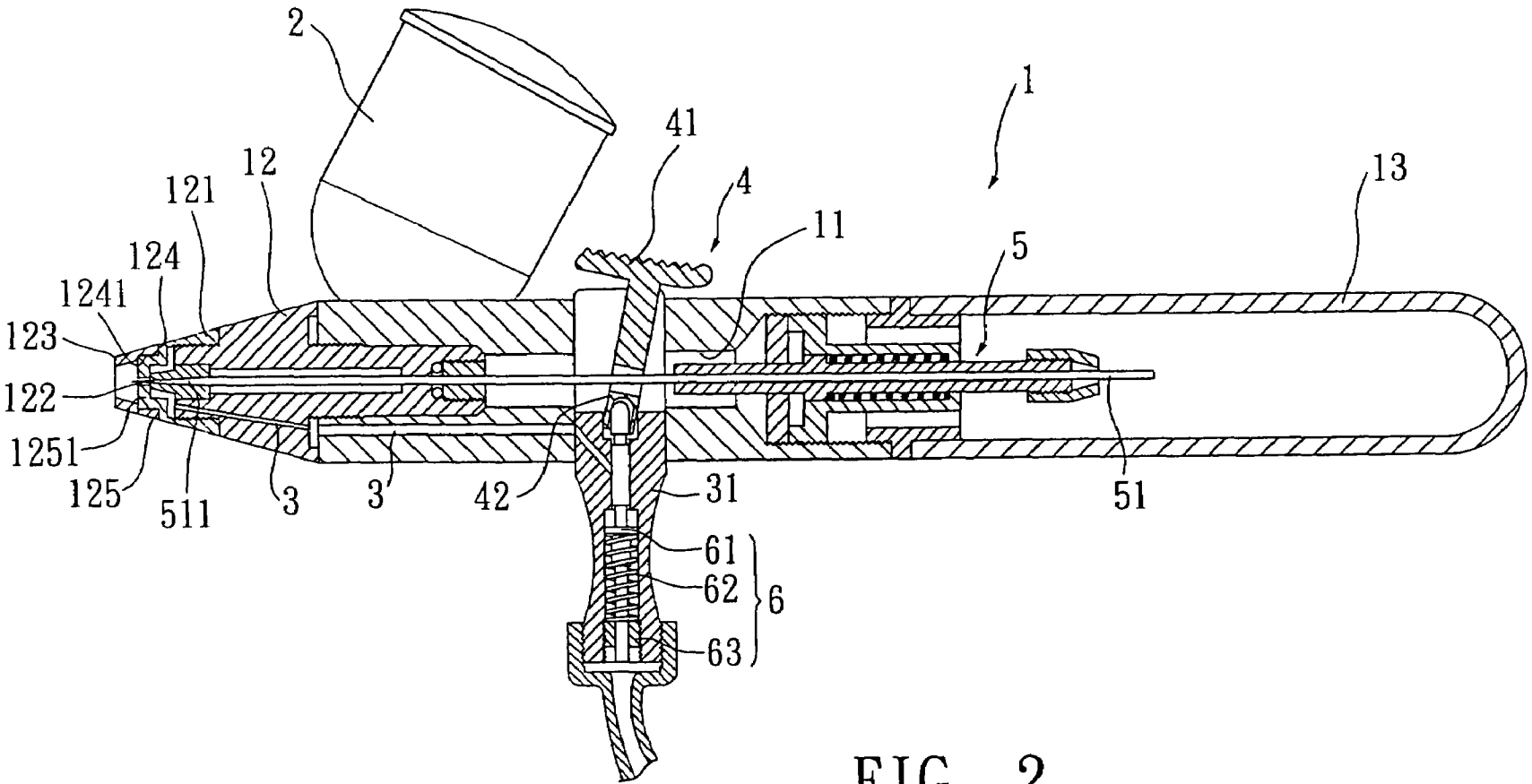
FIG. 2 is a sectional view of the first preferred embodiment of the present invention.
Figure 3:
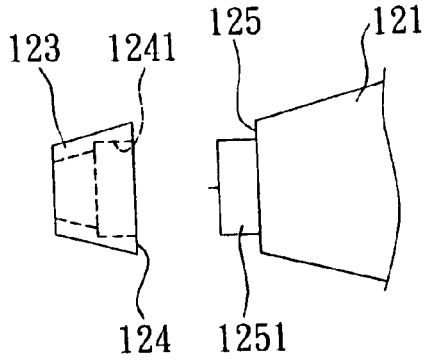
FIG. 3 is a sketch diagram of the nozzle and the nozzle cover of the first preferred embodiment of the present invention.

As shown in FIGS. 1 to 3, an air brush of the first preferred embodiment of the present invention comprises:

A brush member 1 has a chamber 11 and an air channel 3 therein, and has a head portion 12 and a rear portion 13 at opposite end thereof. A nozzle 121 is provided at the head portion 12. The nozzle 121 has an opening 122 communicated with the air channel 3. A nozzle cover 123 is detachably bonded to the nozzle 121.

A paint container 2 has a cup 21 on the brush member 1. The cup 21 has an opening 22 at a top and a bore 23 at a bottom to connect to the chamber 11 via a paint tube 24.

A gas injection member 31 is connected to the brush member 1 and communicated with the air channel 4 to issue a high pressure gas to the opening 122 of the nozzle 121.

An adjustment member 4 has a button portion 41, a post 42 projected from a bottom of the button portion 41 and an aperture 43 on the post 42. The post 42 is inserted into the chamber 11, and the button portion 41 is left out of the brush member 1.

A control assembly 5 is received in the chamber 11 of the brush member 1. The control assembly 5 includes a needle 51 with a tip end 511 and a control set 52. The needle 51 passes through the control set 52 with the tip end 511 received in the nozzle 121. The tip end 511 of the needle 51 of the control assembly 5 is moved inwards and outwards the opening 122 of the nozzle 121 to control the paint flow.

A valve assembly 6 is received in the gas injection member 31 including a shaft 61, a spring 62 and a sleeve 63. The shaft 61 is connected to the post 42 of the adjustment member 4. The spring 62 and the sleeve 63 are fitted to shaft 61. The valve assembly 6 is adapted to open or close the gas injection member 31.

The nozzle cover 123 has a first attracting portion 124 at an end facing the nozzle 121. The nozzle 121 has a second attracting portion 125 associated with the first attracting portion 124 of the nozzle cover 123. The first attracting portion 124 of the nozzle cover 123 has a concave first portion 1241, and the nozzle 121 has a first convex portion 1251 on the second attracting portion 125 to be mated with the concave first portion 1241. The first attracting portion 124 of the nozzle cover 123 is made of a magnetic material, and the second attracting portion 125 of the nozzle 121 is made of iron to be attracted by the first attracting portion 124.

In operation, the button portion 41 of the adjustment member 4 is pressed to move the shaft 61 of the valve member 6, such that the gas is issue to the chamber 11 of the brush member 1. The paint in the cup 21 of the paint container 2 flows to the chamber 11 via the bore 23 and the paint tube 24. Now the adjustment member 4 is moved forward to move the needle 51 to select a suitable gap of the opening 122 the nozzle 121. A difference in pressure between inside and outside of the chamber 11 makes the paint spray out.

The nozzle cover 123 is exerted by a force greater than the magnetic force between the nozzle cover 123 and the nozzle 122 to take off the nozzle cover 123 from the nozzle 122. The nozzle cover 123 may be attracted on a lateral side of the nozzle 122 for the washing process. It prevents the nozzle cover 123 from losing in the washing process. The nozzle cover 123 may cover the nozzle 122 again after the washing process.

Figure 4:
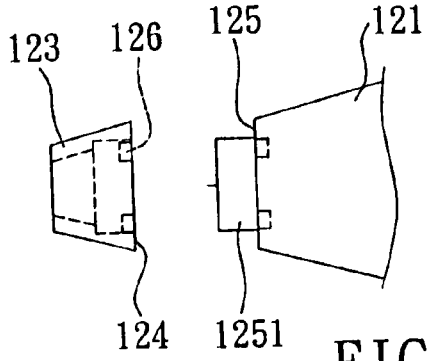
FIG. 4 is a sketch diagram of the nozzle and the nozzle cover of a second preferred embodiment of the present invention.

Another embodiment is shown in FIG. 4, in which the nozzle cover 123 is embedded with two first magnets 126 on the first attracting portion 124 to attract the second attracting portion 125.

The magnets may be provided on the first attracting portion 124 or on the second attracting portion 125. It still provides the nozzle cover 123 bonded to the nozzle 121 by the magnetic force.

Figure 5:
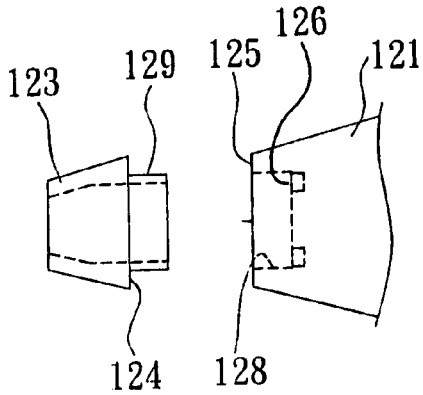
FIG. 5 is a sketch diagram of the nozzle and the nozzle cover of a third preferred embodiment of the present invention.
Figure 6:
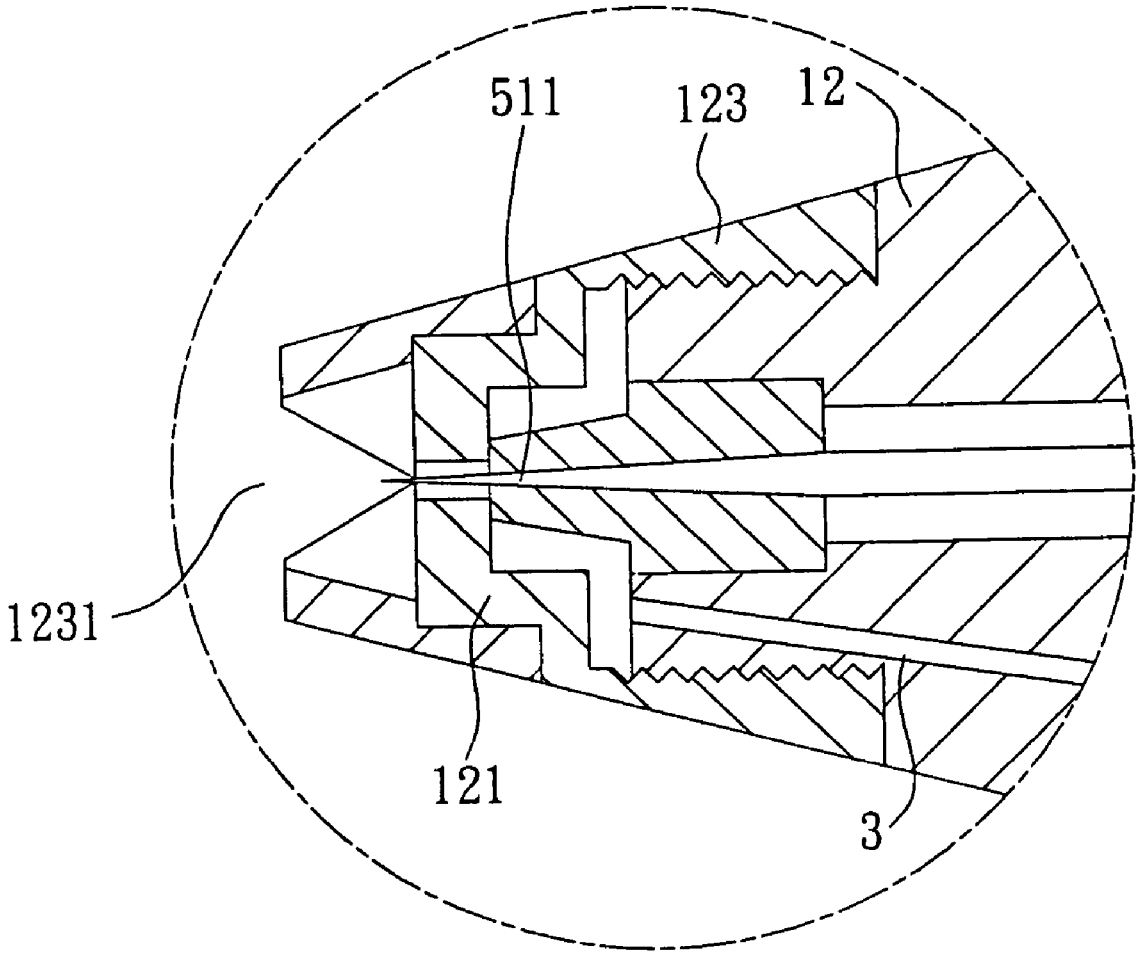
FIG. 6 is a sketch diagram of the nozzle and the nozzle cover of a fourth preferred embodiment of the present invention.
Figure 7:
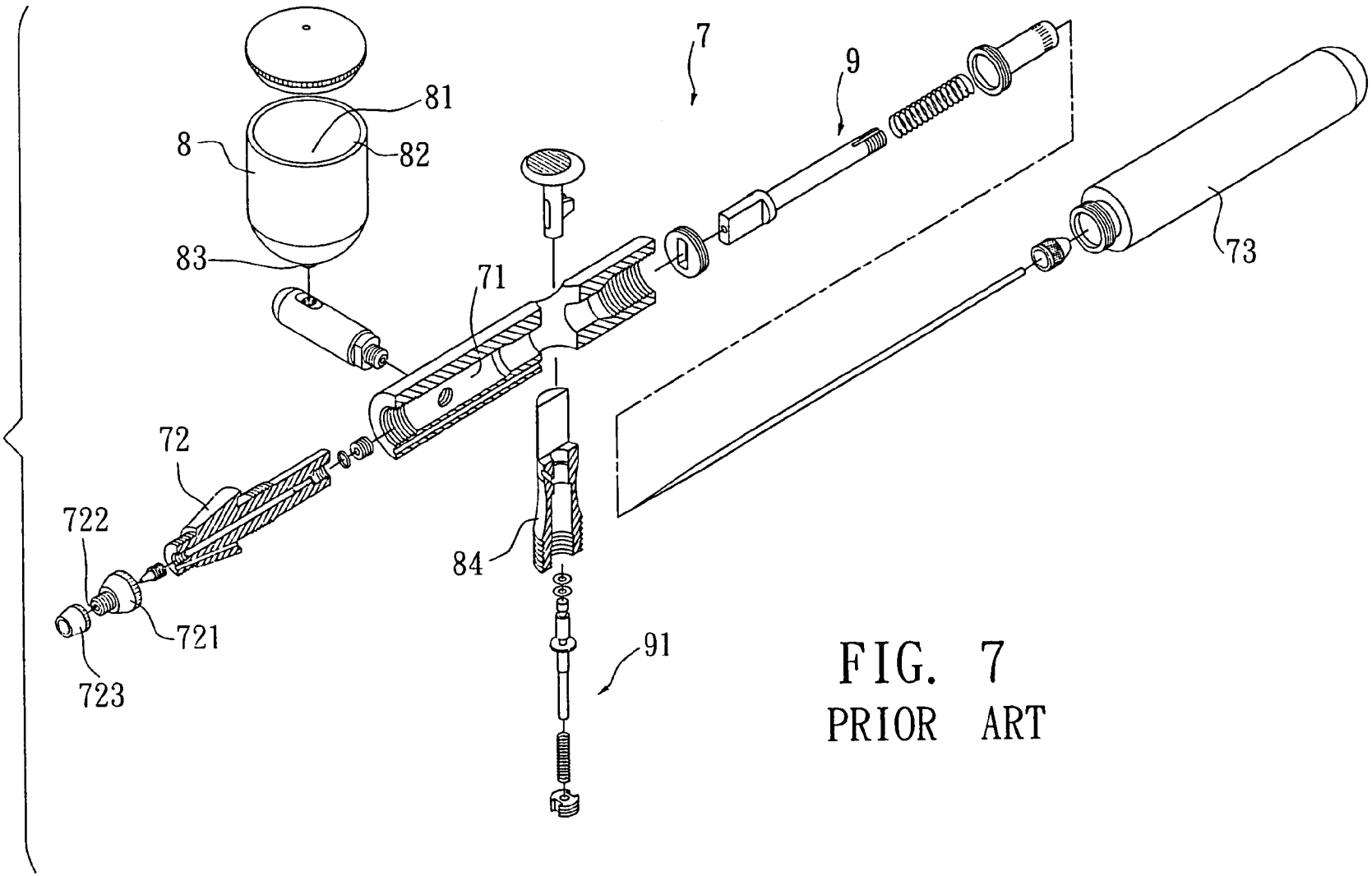
FIG. 7 PRIOR ART
FIG. 7 is an exploded view of the conventional air brush.
Figure 8:
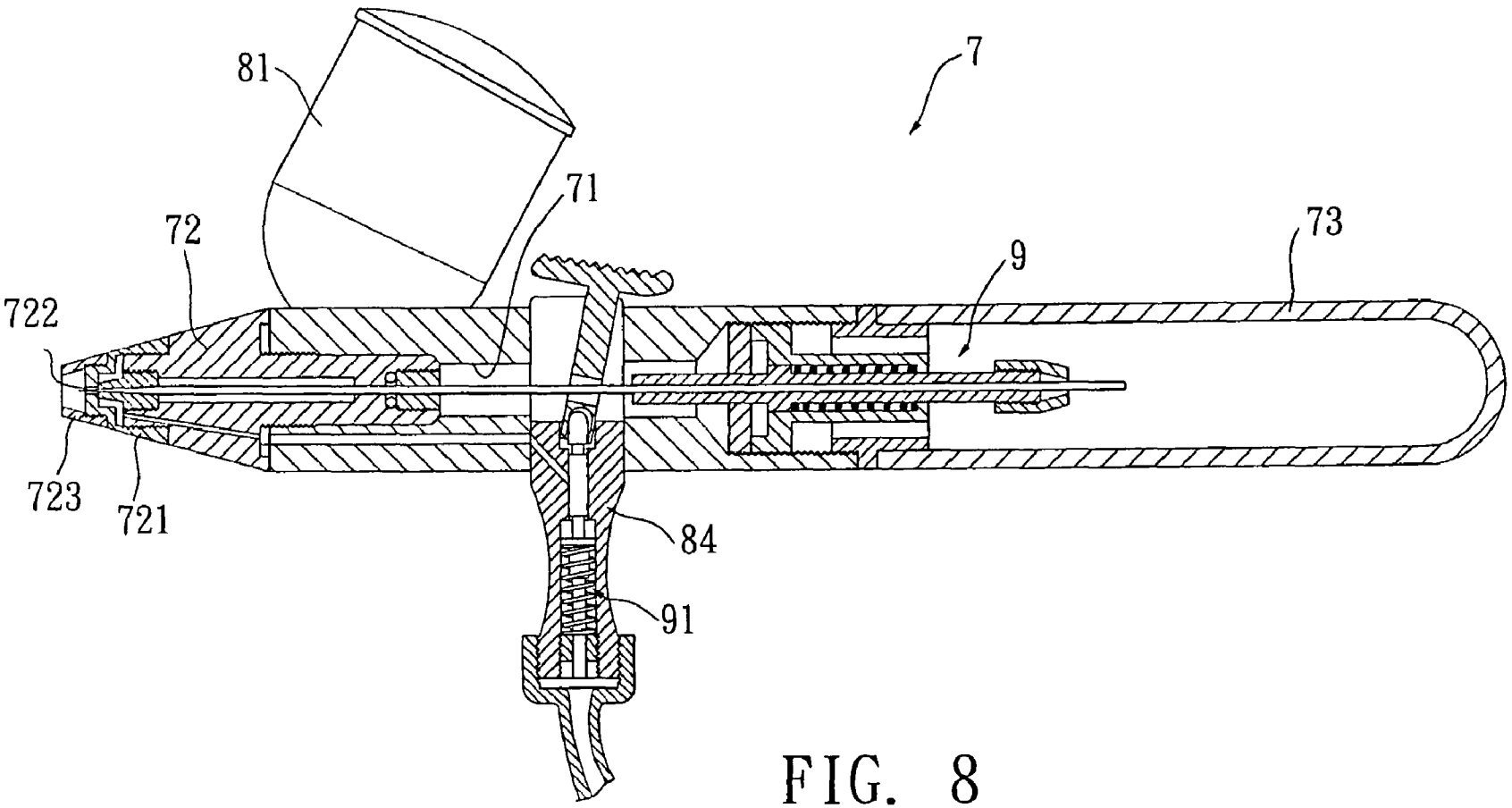
FIG. 8 PRIOR ART
FIG. 8 is a sectional view of the conventional air brush.

FIG. 5 shows the third preferred embodiment of the present invention, in which the nozzle 121 is provided with a first concave portion 128, and the nozzle cover 123 is provided with a first convex portion 129 to be mated with the first concave portion 128.

The fourth preferred embodiment of the present provides two gaps 1231 on the nozzle cover 123 to watch the paint spraying out. The gaps 1231 should be adjusted to suitable locations to facilitate user.

The description above is a preferred embodiment of the present invention and the equivalence of the present invention is still in the scope of the claim of the present invention.

What is claimed is:

1. An air brush, comprising:

a brush member having a head portion and a rear portion on opposite ends and a chamber and an air channel therein a nozzle provided on the head portion of the brush member with an opening;

a nozzle cover detachably coupled to the nozzle;

a paint container provided on the brush member, which has a cup with an opening at a top and a bore at a bottom communicated with chamber of the brush member;

a gas injection member connected to the brush member and communicated with the air channel to issue a high pressure gas to opening of the nozzle;

a valve assembly received in the gas injection member to control a paint flow in the opening of the nozzle;

the nozzle being provided with a convex portion, and the nozzle cover being provided with a concave portion to be mated with the convex portion of the nozzle, the nozzle cover having a first attracting portion, and the nozzle having a second attracting portion corresponding to the first attracting portion, one of the first attracting portion and the second attracting portion having a pair of spaced apart magnets to attract the first attracting portion and the second attracting portion together.

2. An air brush, comprising:

a brush member having a head portion and a rear portion on opposite ends and a chamber and an air channel therein a nozzle provided on the head portion of the brush member with an opening;

a nozzle cover detachably coupled to the nozzle;

a paint container provided on the brush member, which has a cup with an opening at a top and a bore at a bottom communicated with chamber of the brush member;

a gas injection member connected to the brush member and communicated with the air channel to issue a high pressure gas to opening of to nozzle;

a valve assembly received in to gas injection member to control a paint flow in the opening of the nozzle;

the nozzle being provided with a concave portion, and the nozzle cover being provided with convex portion to be mated with the concave portion of the nozzle, the nozzle cover having a first attracting portion, and the nozzle having a second attracting portion disposed in the concave portion and corresponding to the first attracting portion, the second attracting portion having a pair of spaced apart magnets to attract the first attracting portion and the second attracting portion together.

* * * * *